US005949315A

United States Patent [19]

Kalb

[11] Patent Number: 5,949,315

[45] Date of Patent: Sep. 7, 1999

[54] POLARIZED RELAY

[75] Inventor: Roland Kalb, Rossach, Germany

[73] Assignee: Brose Fahrzeugteile GmbH & Co. KG, Coburg, Germany

[21] Appl. No.: 08/860,355

[22] PCT Filed: Dec. 5, 1995

[86] PCT No.: PCT/DE95/01800

§ 371 Date: Jun. 6, 1997

§ 102(e) Date: Jun. 6, 1997

[87] PCT Pub. No.: WO96/18203

PCT Pub. Date: Jun. 13, 1996

[30] Foreign Application Priority Data

Dec. 6, 1994 [DE] Germany ..... 44 45 069

[51] Int. Cl.[6] ..... H01H 9/00

[52] U.S. Cl. ..... 335/179; 335/229; 335/268

[58] Field of Search ..... 335/78–86, 177–179, 335/131, 219, 220, 229, 230, 232, 233, 266, 268

[56] References Cited

U.S. PATENT DOCUMENTS

| | | | |
|---|---|---|---|
| 3,504,320 | 3/1970 | Engdahl et al. | 335/229 |
| 3,518,497 | 6/1970 | Picchia et al. . | |
| 3,995,243 | 11/1976 | Malmborg | 335/179 |
| 4,315,197 | 2/1982 | Studer | 335/229 |
| 4,509,026 | 4/1985 | Matsusuita . | |
| 4,881,054 | 11/1989 | Polgar | 335/230 |
| 5,256,998 | 10/1993 | Becker et al. | 335/229 |
| 5,272,458 | 12/1993 | Hoffmann et al. . | |

FOREIGN PATENT DOCUMENTS

| | | |
|---|---|---|
| A 2635404 | 2/1990 | France . |
| A0 0078324 | 5/1983 | Germany . |
| 35 46 382 | 12/1985 | Germany . |

*Primary Examiner*—Lincoln Donovan
*Attorney, Agent, or Firm*—Christie, Parker & Hale, LLP

[57] ABSTRACT

A polarized relay with an electromagnet which consists of an exciter coil and a coil core mounted in the exciter coil. On each of two end sides of the electromagnet is a permanent magnet displaceable along its magnetic axis. The same pole, for example, the north pole (N), of each of the two permanent magnets face the end sides of the electromagnet. The relay is capable of tri-stable behavior, that is, it can switch between three states, with only one exciter coil. Preferably, the tri-stable function of the relay controls a commutator motor between "rest," "clockwise running," and "counter-clockwise running" states.

14 Claims, 3 Drawing Sheets

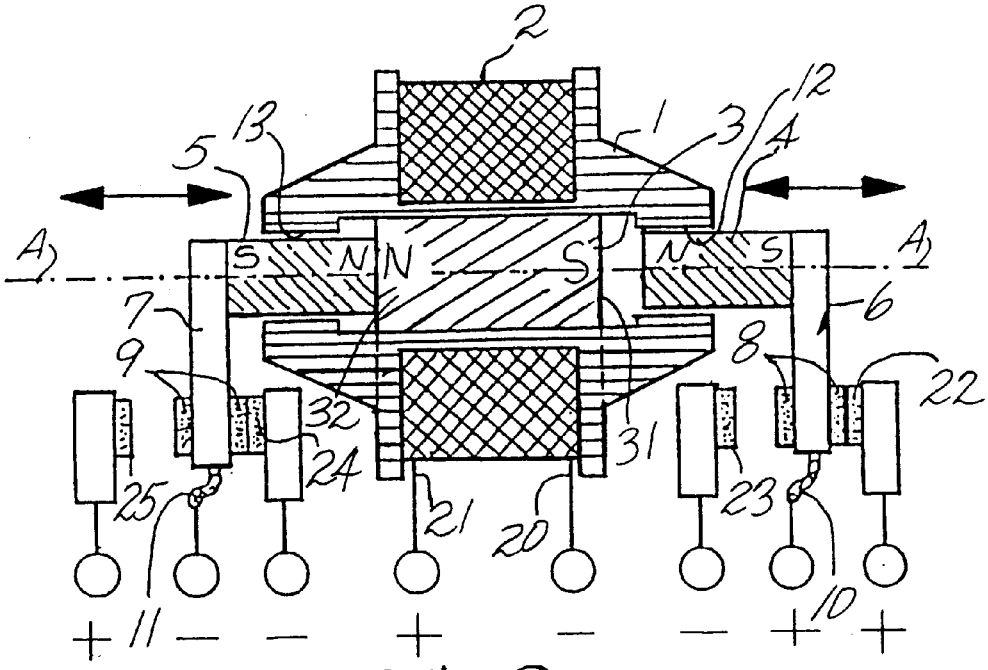
Fig. 2
Fig. 3
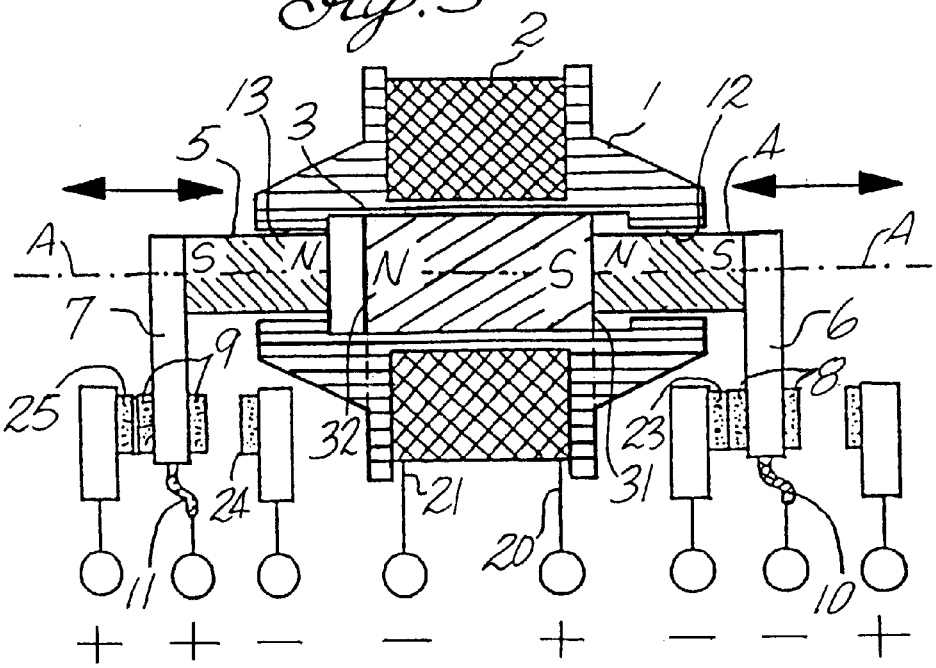

POLARIZED RELAY

BACKGROUND OF THE INVENTION

The invention relates to a polarized relay, and more particularly to a polarized relay having three stable states.

A relay of this kind can be used for example for controlling a commutator motor. This particularly applies when the relay has a tri-stable behavior and the three stable states, and hence, exhibits tri-stable behavior. This tri-stable behavior of the relay can be associated with the motor states "resting," "clockwise running" and "counter-clockwise running."

German Patent No. DE 32 43 266 C2 discloses a polarized relay which consists of two first yokes of U-shaped cross-section facing each other with their short arms and of smaller second yokes enclosed by these at a distance. Between the first and second yokes is a permanent magnet with magnetic axis running at right angles to the large faces of the yokes. The second yokes further comprise an exciter coil which encloses a rod-like armature displaceable in the direction of the coil axis and whose two ends lying outside of the exciter coil are designed as plates which are displaceable between the inner faces of the short arms of the first yokes forming the pole faces, and the end faces of the second yokes. The armature consists of two rod halves divided radially in the center of the exciter coil and between which is mounted a coil compression spring which is tensioned so that the plates of the armature in the currentless state of the exciter coil adjoin the pole faces of the short arms of the first yokes, while in the current-flowing state of the exciter coil, depending on the current flow direction, either the one or the other plate adjoins the corresponding end faces of the second yokes.

This relay shows a tri-stable behavior when using only one exciter coil. Moreover, it has a very expensive and complicated construction of the relay which has in addition to the exciter coil and its twin-divided armature a compression spring, two permanent magnets and four yokes. Furthermore with each switching process the spring force of the compression spring must be overcome by the force of the magnetic field built up by the exciter coil which requires correspondingly high exciter currents.

German Patent No. DE 35 46 382 A1 discloses a polarized electrical mini relay which is formed as a two-fold switch-over relay. A leaf armature and reflux elements are mounted at each of the two free ends of a coil core. The leaf armatures are held by permanent magnets set in series and carry out a synchronous switching process during excitation of the coil.

This two-fold switch-over relay is only provided for a mono- and bi-stable operation. It has the further disadvantage that the design of the reflux elements requires a lot of soft iron in order to ensure the magnetic reflux which is required for a secure function of the relay.

European Patent No. EP 0 474 904 A1 discloses a commutator gear drive unit with an IC block, two motor relays and the brushes of the commutator motor mounted on a conductor plate, but this arrangement is relatively expensive and requires a significant amount of space as a result of using two motor relays.

SUMMARY OF THE INVENTION

According to one embodiment of the invention, there is a polarized relay with an electromagnet which has an exciter coil, a coil core having two end sides and mounted in the exciter coil, and two permanent magnets, one of which is mounted to each end side of the coil core. Each permanent magnet is displaceable along its magnetic axis. The two permanent magnets each face the adjacent end side of the coil core with a like magnetic pole, for example, the magnets' north pole (N).

According to a preferred embodiment of the invention, a polarized relay is provided which has a tri-stable behavior using only one exciter coil, that is, it can produce three states. The polarized relay is simple to construct and switches with the lowest possible exciter currents, making it suitable for controlling electrical consumer devices and/or small mechanical, hydraulic or similar servo devices, especially a commutator motor.

According to another embodiment, a polarized relay with tri-stable behavior and simple construction is provided, including only one exciter coil. A permanent magnet displaceable along its magnetic axis is positioned at each of the two end sides of an electromagnet. The electromagnet is formed by the exciter coil and the coil core mounted therein. The two permanent magnets face the end sides of the coil core with like poles.

When no current flows through the exciter coil, the coil core is polarized magnetically by the permanent magnets so that an attracting alternating action exists between the coil core and each of the two permanent magnets. In this stable rest position of the polarized relay, the two permanent magnets each adjoin with their like poles facing the coil core against an end side of the coil core. In an alternative embodiment, a space is forced between the electromagnet and the two permanent magnets through the use of spacers or the like. When a direct current flows through the coil an attracting magnetic force acts on one of the two permanent magnets and a repelling magnetic force acts on the other, in dependence on the direction of the current. The latter is brought by the repelling magnetic force to a greater distance from the coil core.

Overall, with the relay according to an embodiment of the invention, three states can be produced, i.e., the relay shows tri-stable behavior. This is achieved by using only one electromagnet and two permanent magnets, whereby during the switching processes only slight forces have to be overcome since the position of the two permanent magnets is only determined by the acting magnetic forces. No spring forces or similar mechanical forces occur or are required to switch the relay.

Thus the polarized relay according to the various embodiments of the invention is suitable for triggering switching processes with low exciter currents, and more particularly for controlling electrical consumer devices, as well as small mechanical, hydraulic or similar servo devices.

A preferred embodiment of the invention is characterized in that with a currentless exciter coil the two permanent magnets each adjoin an end side, respectively, of the coil core and with direct current flowing through the coil of a predetermined strength, each one of the permanent magnets can be brought into a predetermined distance from the coil core in dependence on the direction of the current. With this embodiment of the invention the switching processes can be carried out with particularly small magnetic forces, since the permanent magnets are located directly adjoining the electromagnets and, when no current flows through the exciter coil, even adjoin the end sides thereof. Preferably, the magnitudes of the magnetic force of permanent magnets and the exciter currents are matched with each other to guarantee a secure switching process.

To fix relay contacts on the two permanent magnets, the ends of the permanent magnets remote from the coil core are each provided with a holding plate for the relay contacts. In this case the relay is preferably designed so that the relay contacts fixed on the holding plates of the permanent magnets with a no current in the exciter coil, are switched to identical first potentials, and that when direct current flows through the exciter coil, in dependence on the direction thereof, each one of the relay contacts is switched by magnetic repulsion of the associated permanent magnet to another, second potential.

In order to ensure a safe displacement of the permanent magnets relative to the coil core in dependence on the acting magnetic forces, according to one embodiment, the exciter coil is wound onto a foundation body in which the coil core is locally fixed and in which a permanent magnet is opposite each of the two end sides of the coil core, each permanent magnet being displaceable in an associated guide of the foundation body along its magnetic axis.

The polarized relay according to one embodiment of the invention is suitable for use with the control device of a commutator motor with a conductor plate on which a control electronics unit, the brushes of a commutator motor, and the polarized relay are mounted.

This control device for a commutator motor is advantageously characterized by the simple construction and the small space required by the polarized relay which controls the current flow of the commutator motor with only one exciter coil. Through the compact method of construction of the relay, the control electronics for the motor, the polarized relay and the brushes of the commutator motor can be arranged in a space-saving manner on a conductor plate. This also leads to a reduction in the manufacturing costs.

The device according to the invention has an important advantage over the prior art in that through the particularly simple compact design of the polarized relay, the control device for the commutator motor can be made significantly more cost-effectively and requires less space.

According to another embodiment, the required contact between the brushes of the commutator motor arranged on the conductor plate and the commutator is made possible in that the conductor plate has a recess in which the commutator is mounted and into which the brushes of the commutator motor project. In another embodiment, compression springs are used to press the brushes against the commutator.

A particularly compact arrangement of the control for a commutator motor on a conductor plate is possible if the polarized relay is mounted directly adjacent the brushes of the commutator motor. Accordingly, the design of the polarized relay is adapted to the path of the wall of the recess for the commutator so that the outer contour of the relay runs at least in a section along the wall of the recess. Through the simple construction of the relay according to the various embodiments of the invention, this is possible with a suitable design of the component parts, more particularly the foundation body and coil core, even if the wall of the recess has a curvature in the said section.

DESCRIPTION OF THE DRAWINGS

The invention will now be explained in further detail with reference to the embodiments shown in the drawings in which:

FIG. 2 shows the polarized relay according to FIG. 1 with an exciter coil through which exciter current flows in a first direction;

FIG. 3 shows the polarized relay according to FIG. 1 with an exciter coil through which the exciter current flows in the opposite direction to the flow direction according to FIG. 2.

DETAILED DESCRIPTION OF THE INVENTION

Figure 1:
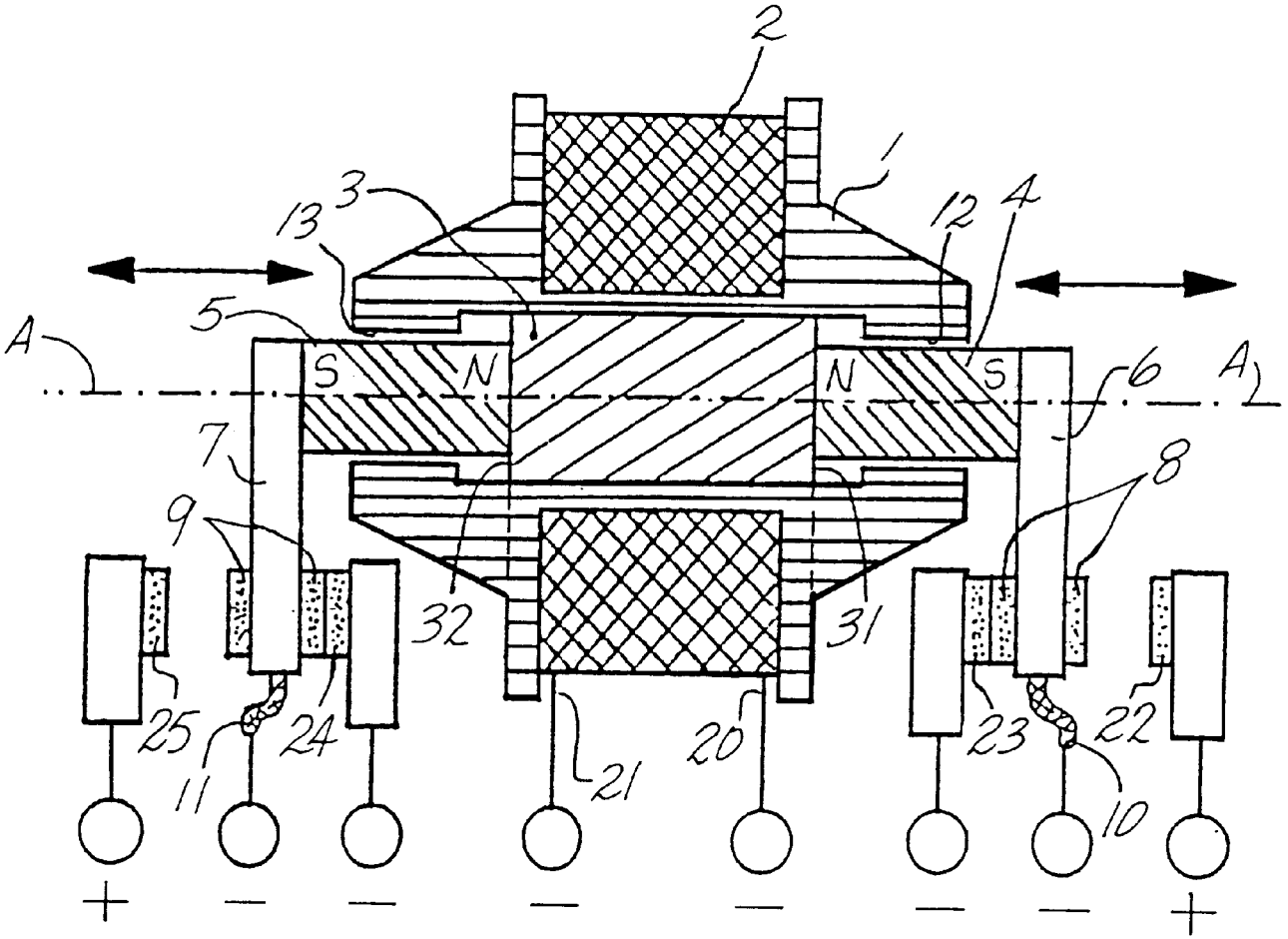
FIG. 1 is a longitudinal sectional view through a polarized relay according to one embodiment of the invention with the exciter coil in a currentless state.

FIG. 1 shows an embodiment of the polarized relay according to the invention. An exciter coil 2 is mounted on a foundation body 1 and a soft iron core 3 is locally fixed in the exciter coil as the coil core. The exciter coil 2 and the coil core 3 thus form an electromagnet. Permanent magnets 4, 5 are mounted on each of two end sides 31, 32 of the coil core 3. The permanent magnets 4, 5 are displaceable in associated guides 12, 13 of the foundation body 1 along a magnetic axis (shown as axis A on FIG. 1). The permanent magnets 4, 5 are each facing one of the end sides 31, 32 of the coil core 3 with like magnetic poles, for example, north pole (N). A holding plate 6, 7 for each of two-part relay contacts 8, 9 is fixed on each end of the permanent magnets 4, 5 remote from the coil core 3 in this example, south pole (S) of the permanent magnets. The relay contacts 8, 9 can be connected conductively for example to the brushes of a commutator motor by flexible copper flexes 10, 11.

According to FIG. 1, two terminals 20, 21 of the exciter coil 2 are located on the same potential, for example, negative potential (−), so that the exciter coil 2 is currentless. The coil core 3 is then magnetically polarized by the permanent magnets 4, 5 so that an attracting magnetic alternating action exists between the coil core 3 and the permanent magnets 4, 5. Therefore the two permanent magnets 4, 5 each adjoin with their north poles (N) facing the coil core 3 against a different one of the end sides 31, 32 of the coil core 3. The relay contacts 8 and 9 fixed on the holding plates 6, 7 are then in contact with the stationary load contacts 23, 24 which are both located on negative potential (−). The relay contacts 8, 9 and the associated flexible copper flex 10, 11 are thereby also switched to the same potential so that a commutator motor attached to the copper flex 10, 11 would not be energized, and thus, corresponds to a "resting" state of the commutator motor.

FIGS. 2 and 3 show the embodiment of a polarized relay according to FIG. 1 wherein now the terminals 20, 21 of the exciter coil 2 are located at different potentials and the exciter coil 2 is charged with direct current. The positions of the relay shown in FIGS. 2 and 3 correspond to "clockwise running" and "counter-clockwise running" states of the commutator motor.

According to the state of the polarized relay shown in FIG. 2, the terminal 20 of the exciter coil 2 is located on a negative (−) potential and the other terminal 21 is on a positive potential (+). The exciter coil 2 is then charged with a current so that the end side 31 of the coil core functions as a north pole (N) whereas, a south pole (S) forms on the other end side 32. Since both permanent magnets 4, 5 face the coil core 3 with their north pole (N), the permanent magnet 4 is repelled by the end side 31 of the coil core 3, and the permanent magnet 5 is stabilized in its position in contact with coil core 3 by a greater attraction force. The relay contact 8 thereby comes in contact with the load contact 22 and is correspondingly switched to a positive potential (+) whereas, the relay contact 9 remains at its negative potential (−).

As a result of the switching process triggered by the current through the exciter coil 2, the two flexible copper flexes 10 and 11 are now located at different potentials (+) and (−) so that a commutator motor attached to these flexes 10, 11 would be caused to turn in a certain direction.

According to the state of the polarized relay shown in FIG. 3, the opposite voltage to FIG. 2 is connected to the terminals 20, 21 of the exciter coil 2. The exciter coil 2 is then charged with a current so that the end side 31 of the coil core functions as a south pole (S) whereas a north pole (N) is formed on the other end side 32. The permanent magnet 5 is repelled by the end side 32 of the coil core 3. The relay contact 9 thereby comes into contact with the load contact 25 and is switched to a positive potential (+). The relay contact 8 is accordingly switched to negative potential (−) since the permanent magnet 4 is magnetically attracted by the coil core 3 and therefore adjoins the end side 31 of the coil core 3 with its north pole (N).

The potential difference between the flexible copper flexes 10, 11 is opposite to that shown in FIG. 2, and a commutator motor attached to these flexes would turn in the opposite direction.

Figure 4:
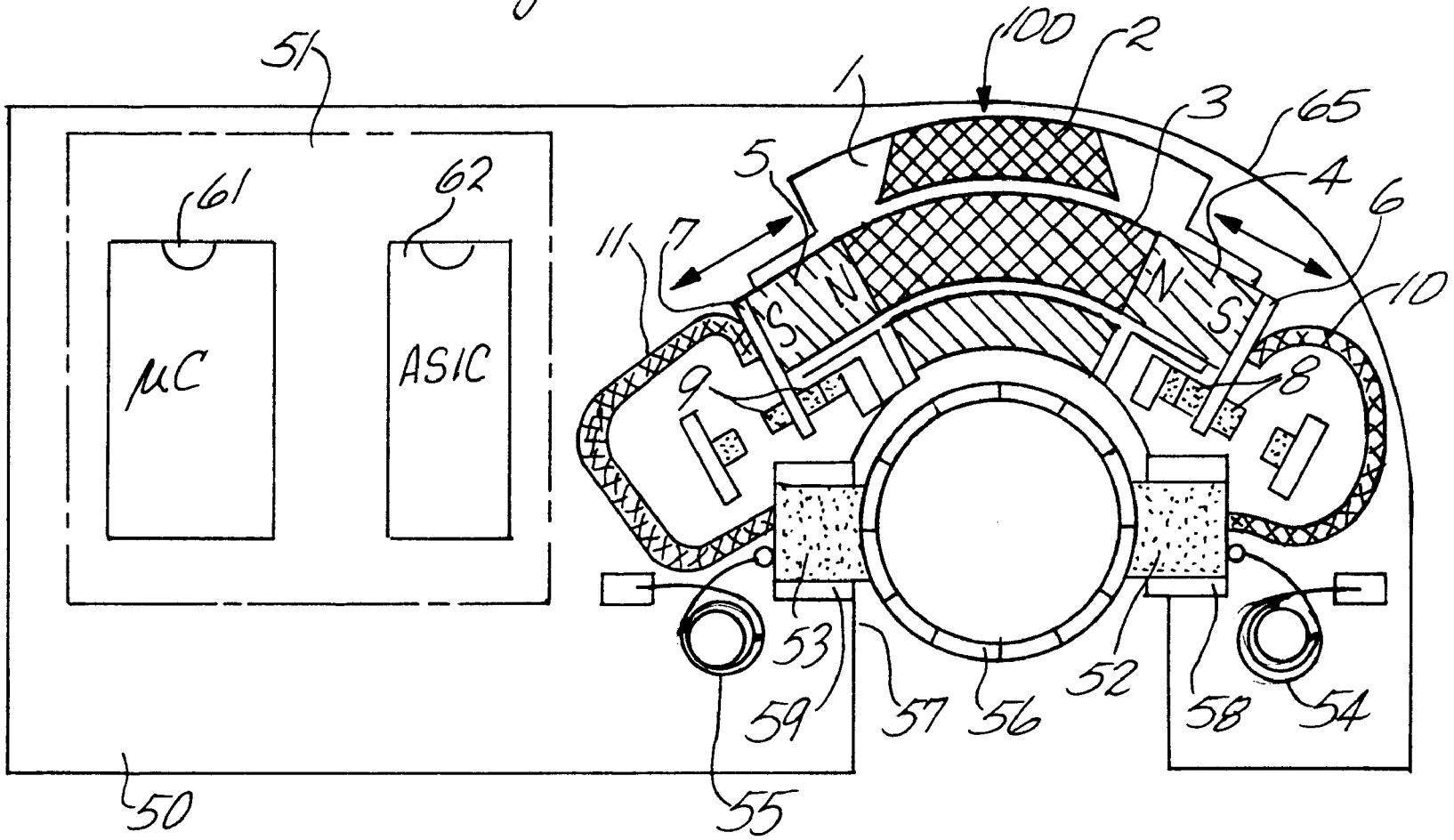
FIG. 4 shows a control device mounted on a conductor plate for a commutator motor with a polarized relay mounted near the brushes.

FIG. 4 shows one embodiment of a control device according to the present invention for use with a commutator motor (not shown) wherein a polarized relay 100 is used to control the motor and its component parts are arranged in a space saving configuration on a conductor plate 50. This compact construction is allowed in the first instance through the particularly simple construction of the polarized relay.

The conductor plate 50, which in this embodiment is about twice as long as it is wide, substantially splits in its longitudinal direction into two sections of which one has the control electronics 50 and the other is provided with a pair of brushes 52, 53 of the commutator motor as well as the polarized relay 100, by means of which the current of the brushes 52, 53 is controlled.

The control electronics 51 comprise for example a micro processor ($\mu$C) 61 and an integrated switch circuit (IC) 62 which is specific for the case of use. The brushes 52, 53 of the commutator motor are fixed on brush holders 58, 59 and project into a recess 57 of the conductor plate 50 through which a commutator 56 of a commutator motor is guided. By means of compression springs 54, 55, the brushes 52, 53 are pressed resiliently against the commutator 56.

The clear structural separation of the control and power parts reduces the danger of breakdowns which can be caused by electromagnetic fields and thus increases the electromagnetic compatibility of the system.

The brushes 52, 53 are connected by flexible copper flexes 10, 11 to the relay contacts 8, 9 fixed on the holding plates 6, 7. The polarized relay 100 is mounted directly on the recess 57 adjoining the commutator 56 and has principally the same construction and the same method of functioning as the embodiment of the relay described above with reference to FIGS. 1 to 3. The relay 100 differs from that embodiment described according to FIGS. 1 to 3 only in that the foundation body 1, on which the exciter coil 2 is wound, and the coil core 3 have a curved shape so that the outer contour of the relay 100 adjoining the recess 57 runs at least in one section along the curved wall of the recess 57. As a result of its simple construction and through suitable shaping of the few component parts of which it consists, the relay can also be adapted to further spatial requirements, for example a rounded end section 65 of the conductor plate 50.

By adapting the shape of the polarized relay 100 to the shape of the recess 57 for the commutator 56 or where applicable for other spatial requirements, it is possible to save further space. In short, the very compact design of the control device for the commutator motor is reached in the first instance in that the polarized relay, by means of which the commutator motor is controlled, requires sufficient space for only one exciter coil, a coil core and two permanent magnets, if one disregards the relay contacts and similar very small components.

The control device therefore allows a significant space and costs saving compared to the prior art relays where two relays are mounted on a conductor plate for controlling a commutator motor.

The function of the relay 100 when controlling the flow of current to the brushes 52, 53, and thus the turning direction of the motor, need therefore not be explained again since it was already illustrated in detail above with regard to FIGS. 1 to 3. In connection with FIG. 4, it need only be mentioned that the control electronics 51 serve to control the input voltage at the exciter coil 2 through which the switch processes are triggered in the polarized relay 100.

The invention is not restricted in its useful area only to the illustrated embodiments but can also be used as control, servo and drive device for small mechanical, electromechanical, hydraulic, pneumatic or similar servo devices.

While preferred embodiments of the invention have been illustrated and described, it should be understood that variations will be apparent to those skilled in the art. Accordingly, the invention is not to be limited to the specific embodiments illustrated and described, but should be determined by reference to the following claims.

I claim:

1. A polarized relay within electromagnet comprising:

an exciter coil;

a coil core, having first and second end sides, fixedly mounted in the exciter coil;

first and second permanent magnets, each said permanent magnet being independently displaceable from the coil core along its longitudinal axis and been mounted adjacent a different one of the two end sides of the coil core, and wherein each of the two permanent magnets has a like magnetic pole facing the adjacent one of the end sides of the coil core;

wherein with no current through the exciter coil, the two permanent magnets each adjoin an adjacent one of the end sides of the coil core; and wherein with direct current through the exciter coil of a predetermined strength and in dependence on the direction of the current through the exciter coil, each of the permanent magnets can be brought by magnetic repulsion into a predetermined distance from the coil core.

2. A polarized relay according to claim 1 further comprising:

first and second holding plates, each holding plate provided at an end of a different one of the permanent magnets remote from the coil core; and first and second relay contacts, each relay contact fixed to a different one of the holding plates.

3. A polarized relay according to claim 2 wherein with no current through the exciter coil, the relay contacts are fixed on the respective end of the holding plates of the permanent magnets with a currentless exciter and are switched to a first electrical potential and that with direct current flowing through the exciter coil, each one of the relay contacts is switched by magnetic repulsion of the associated permanent magnet to a second electrical potential in dependence on the direction of the current.

4. A polarized relay according to claim 1 further comprising a foundation body, including two guides positioned along a longitudinal axis of the foundation body, wherein the exciter coil is wound onto the foundation body and the coil core is fixed in the foundation body, and in which each of the permanent magnets being mounted adjacent a different one of the two end sides of the coil core, and wherein the permanent magnets are displaceable in the guides of the foundation body along the longitudinal axis of the foundation body.

5. A polarized relay according to claim 2 for controlling a commutator motor wherein each of the relay contacts is connected conductively to an associated one of a plurality of brushes of the commutator motor by flexible copper flexes.

6. A control device for a commutator motor with a conductor plate on which at least one control electronics device, first and second brushes of a commutator motor, and a polarized relay are mounted comprises:

an electromagnet comprising:

an exciter coil; and a coil core having first and second ends, and fixedly mounted in the exciter coil;

first and second permanent magnets, each of the permanent magnets being mounted adjacent a different one of the two end sides of the coil core and being independently displaceable from the coil core along its longitudinal axis, which face with like magnetic poles each adjacent one of the end sides of the coil core; and first and second relay contacts, each of the relay contacts conductively connected to a different one of the two brushes of the commutator motor and each associated with a different one of the permanent magnets;

wherein with no current through the exciter coil, the two permanent magnets each adjoin an adjacent one of the end sides of the coil core; and wherein with direct current through the exciter coil of a predetermined strength and in dependence on the direction of the current through the exciter coil, each of the permanent magnets can be brought by magnetic repulsion into a predetermined distance from the coil core.

7. A device according to claim 6 wherein the relay contacts are switched with no current through the exciter coil to a first potential and with direct current flowing through the exciter coil, each one of the relay contacts is switched by magnetic repulsion of the associated permanent magnet to a second potential in dependence on the direction of the current.

8. A device according to claim 6 further comprising first and second holding plates, wherein each of the first and second relay contacts is attached to a different one of the holding plates, and wherein each holding plate is fixed to an end of a different one of the permanent magnets remote from the coil core.

9. A device according to claim 6 further comprising a foundation body comprising first and second guides positioned along a longitudinal axis of the foundation body, wherein the exciter coil is wound onto the foundation body and the coil core is fixed in the foundation body, and in which each of the permanent magnets being mounted adjacent a different one of the first and second end sides of the coil core, and wherein each permanent magnet is displaceable in a different one of the guides of the foundation body along the longitudinal axis.

10. A device according to claim 6 wherein the conductor plate has a recess in which such commutator motor is mounted and through which the brushes of the commutator motor project.

11. A device according to claim 10 wherein the polarized relay is mounted directly adjacent the brushes of the commutator motor.

12. A device according to claim 11 wherein the shape of the polarized relay is adapted to a path of a wall of the recess so that an outer contour of the relay runs at least in one section along the wall of the recess.

13. A device according to claim 12 wherein the outer contour of the polarized relay has at least one curved section which is adapted to a curvature of the wall of the recess.

14. A control device for a commutator motor with a conductor plate on which at least one control electronics device, first and second brushes of a commutator motor, and a polarized relay are mounted comprises:

an electromagnet comprising:

an exciter coil; and a coil core having first and second ends;

first and second permanent magnets, each of the permanent magnets being mounted adjacent a different one of the two end sides of the coil core and being independently displaceable from the coil core along its longitudinal axis, which face with like magnetic poles each adjacent one of the end sides of the coil core; and first and second relay contacts, each of the relay contacts conductively connected to a different one of the two brushes of the commutator motor and each associated with a different one of the permanent magnets;

wherein the coil core is fixedly mounted in the exciter coil.

* * * * *